US012808618B1

(12) United States Patent
Vicars, III

(10) Patent No.: US 12,808,618 B1
(45) Date of Patent: Nov. 24, 2026

(54) FIREARM MAGAZINE CONVERSION SYSTEM

(71) Applicant: Tandem Kross, LLC, Hooksett, NH (US)

(72) Inventor: Joseph Watson Vicars, III, Louisville, KY (US)

(73) Assignee: Tandem Kross, LLC, Weare, NH (US)

( * ) Notice: Subject to any disclaimer, the term of this patent is extended or adjusted under 35 U.S.C. 154(b) by 0 days.

(21) Appl. No.: 19/291,436

(22) Filed: Aug. 5, 2025

Related U.S. Application Data

(60) Provisional application No. 63/679,282, filed on Aug. 5, 2024.

(51) Int. Cl.
*F41A 3/66* (2006.01)
*F41A 9/56* (2006.01)

(52) U.S. Cl.
CPC . *F41A 3/66* (2013.01); *F41A 9/56* (2013.01)

(58) Field of Classification Search
CPC ..... F41A 3/66; F41A 9/56
See application file for complete search history.

(56) References Cited

U.S. PATENT DOCUMENTS

| | | | | |
|---|---|---|---|---|
| 3,776,095 | A * | 12/1973 | Atchisson | F41A 11/02 89/149 |
| 9,194,638 | B2 * | 11/2015 | Larson, Jr. | F41A 3/72 |
| 12,313,366 | B2 * | 5/2025 | Geissele | F41A 35/06 |
| 12,332,013 | B2 * | 6/2025 | Brown | F41A 9/69 |
| 12,663,228 | B2 * | 6/2026 | Kielsmeier | F41A 9/70 |
| 2019/0093978 | A1 * | 3/2019 | Maugham | F41A 17/36 |
| 2025/0027734 | A1 * | 1/2025 | Roberts | F41A 9/70 |
| 2025/0207881 | A1 * | 6/2025 | Underwood | F41A 9/70 |
| 2026/0092751 | A1 * | 4/2026 | Foster | F41A 9/58 |
| 2026/0104218 | A1 * | 4/2026 | Foster | F41A 9/58 |

* cited by examiner

*Primary Examiner* — Michelle Clement
(74) *Attorney, Agent, or Firm* — HAYES SOLOWAY P.C.

(57) ABSTRACT

A firearm magazine conversion system includes a lower receiver housing connectable to an upper receiver assembly of a firearm. The upper receiver assembly has a factory bolt. An internal channel is within the lower receiver housing for receiving a magazine. A center axis of the internal channel aligned with a length of the internal channel is non-intersecting with a center axis of a bore of the firearm. The center axis of the internal channel is non-perpendicular to the center axis of the bore of the firearm in at least one plane.

20 Claims, 11 Drawing Sheets

FIREARM MAGAZINE CONVERSION SYSTEM

CROSS REFERENCE TO RELATED APPLICATION

This application claims benefit of U.S. Provisional Application Ser. No. 63/679,282 entitled "Firearm Magazine Conversion System" filed Aug. 5, 2024, the entire disclosure of which is incorporated herein by reference.

FIELD OF THE DISCLOSURE

The present disclosure is generally related to firearms, and more particularly is related to a firearm magazine conversion system.

BACKGROUND OF THE DISCLOSURE

Firearms are initially assembled with stock components, which may be referred to as original equipment manufacturer (OEM) or factory components. These components are designed by the manufacturer during engineering of the firearm. While these factory components are sufficient for standard use and operation of the firearm, they often prevent the user from achieving new functionality or improved performance of the firearm. As a result, it is common for firearms to be modified after purchase by a user, such as by replacing of certain factory components or parts of the firearm with new, or aftermarket components. For instance, a user may opt to install new sights on a firearm, or replace a factory grip with an aftermarket grip which offers improved performance.

One particular area for aftermarket modifications is with the lower receiver assembly or trigger housing, which typically includes components of the magazine system of a firearm. For instance, many existing firearms use an OEM 10-round rotary magazine. These magazines can be inefficient to load and unload, and they have limited capacity. Replacing this factory magazine with an aftermarket magazine, such as a linear magazine with rounds positioned in a stacked and staggered configuration, may allow the user to perform load/reload operations faster, gain a larger magazine capacity, or achieve other benefits. If a user wants to replace the factory magazine, he or she would typically need to install a new lower receiver assembly or trigger housing which corresponds to the design of the new magazine. It is often the case that a particular lower receiver assembly or trigger housing is required for a particular magazine.

Additionally, replacement of the these components also affects the positioning of the cartridges or rounds delivered from the magazine relative to the breech and bolt. OEM rotary magazines are designed to provide a particular discharge position or resting position of a cartridge, such that it can be moved to the breech by the bolt. Replacing the lower receiver assembly and magazine conventionally changes that discharge or resting position, which makes the OEM or factory bolt non-functional with the aftermarket modifications. Thus, when replacing a factory lower receiver or trigger housing, replacement of the original factory bolt is often required. This presents additional complications, since replacement of the factory bolt requires a more extensive disassembly of the firearm than many users are capable of. This can lead to potential safety issues with future operation of the firearm if the user does not have sufficient knowledge of the device and its operation. The need to replace the factory bolt also increases the costs of the modifications to the firearm.

SUMMARY OF THE DISCLOSURE

Embodiments of the present disclosure provide a firearm magazine conversion system. Briefly described, in architecture, one embodiment of the system, among others, can be implemented as follows. A firearm magazine conversion system includes a lower receiver housing connectable to an upper receiver assembly of a firearm. The upper receiver assembly has a factory bolt. An internal channel is within the lower receiver housing for receiving a magazine. A center axis of the internal channel aligned with a length of the internal channel is non-intersecting with a center axis of a bore of the firearm. The center axis of the internal channel is non-perpendicular to the center axis of the bore of the firearm in at least one plane.

In one aspect, the center axis of the internal channel is positioned lateral to the center axis of the bore.

In another aspect, a second axis is perpendicular to the center axis of the bore of the firearm, wherein the center axis of the internal channel is non-perpendicular to the second axis of the bore of the firearm.

In yet another aspect, the internal channel is radially angled relative to the center axis of the bore.

In yet another aspect, the system further comprises a feed ramp within the lower receiver housing in a position proximate to a terminating upper end of the internal channel, the feed ramp having a feeding surface which forms a plane of symmetry that intersects both a cartridge position in a top position of a magazine within the internal channel and an entrance to the bore along the center axis of the bore.

In this aspect, the feeding surface is at least partially a concave surface.

In this aspect, the feed ramp is removably mounted to the lower receiver housing with fasteners.

In yet another aspect, the system comprises a magazine adapter removably mounted within the lower receiver housing with at least one fastener, wherein the internal channel is formed within the magazine adapter.

The present disclosure can also be viewed as providing a firearm magazine conversion system. Briefly described, in architecture, one embodiment of the system, among others, can be implemented as follows. A lower receiver housing is connectable to an upper receiver assembly of a firearm, the upper receiver assembly having a factory bolt. An internal channel is within the lower receiver housing. A magazine is positioned within the internal channel. A center axis of the internal channel aligned with a length of the internal channel is non-intersecting with a center axis of a bore of the firearm, and the center axis of the internal channel is non-perpendicular to the center axis of the bore of the firearm in at least one plane.

In one aspect, the center axis of the internal channel is positioned lateral to the center axis of the bore.

In another aspect, a second axis is perpendicular to the center axis of the bore of the firearm, wherein the center axis of the internal channel is non-perpendicular to the second axis of the bore of the firearm.

In another aspect, the internal channel is radially angled relative to the center axis of the bore.

In yet another aspect, the system further comprising a feed ramp within the lower receiver housing in a position proximate to a terminating upper end of the internal channel, the feed ramp having a feeding surface which forms a plane of symmetry that intersects both a cartridge position in a top position of the magazine within the internal channel and an entrance to the bore along the center axis of the bore.

In this aspect, the feeding surface is at least partially a concave surface.

In this aspect, the feed ramp is removably mounted to the lower receiver housing with fasteners.

In yet another aspect, a magazine adapter is removably mounted within the lower receiver housing with at least one fastener, wherein the internal channel is formed within the magazine adapter, and wherein the magazine is positioned at least partially within the magazine adapter.

In another aspect, the magazine is a stacked-cartridge magazine.

In this aspect, the magazine has a feed lip, wherein the feed lip causes a rim of a cartridge to raise as the cartridge is moved into a breech of the firearm.

The present disclosure can also be viewed as providing a firearm magazine conversion system. Briefly described, in architecture, one embodiment of the system, among others, can be implemented as follows. A lower receiver housing is connectable to an upper receiver assembly of a firearm, the upper receiver assembly having a factory bolt. An internal channel is within the lower receiver housing for receiving a magazine, wherein a center axis of the internal channel aligned with a length of the internal channel is non-intersecting with a center axis of a bore of the firearm, and wherein the center axis of the internal channel is non-perpendicular to the center axis of the bore of the firearm in at least two planes.

In this aspect, a second axis is perpendicular to the center axis of the bore of the firearm, wherein the center axis of the internal channel is non-perpendicular to the second axis of the bore of the firearm.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

The present disclosure is directed to a system which allows for replacement of a factory or OEM lower receiver assembly or trigger housing with an aftermarket device which is capable of receiving various magazines which have a stacked-cartridge design. The system has a particular design which allows for the magazine to achieve an orientation which positions the cartridge in a discharge or resting location which is equivalent, or functionally equivalent, to the discharge or resting position provided by the original OEM device. As such, the system provides the ability to effectively match the exit geometry of the discharge position or resting position of a cartridge between the conventional rotary magazines which are factory-produced relative to a stacked-cartridge magazine having a linearly-stacked and staggered cartridge configuration. Importantly, use of the system allows for continued use of the factory bolt, e.g., the bolt having the original manufacture design and not an aftermarket bolt design, thereby allowing easy adoption and installation of the system. Specifically, the system allows for use with the firearm without requiring the user to replace a factory bolt, which, as discussed previously, is a complex technical process which often requires specialized expertise.

The particular design of the system increases complexity of manufacturing relative to conventional devices, namely due to the various off-center or asymmetrical designs incorporated in the system. For example, the angles of the system may be harder to manufacture with injection molding due to the lack of straight parts or perpendicular angles, in contrast to conventional devices which typically position a magazine channel that is straight and perpendicular to the bore. However, the features of the system ensure that the factory bolt can be retained, thus lowering installation complexity and costs.

Figure 2A:
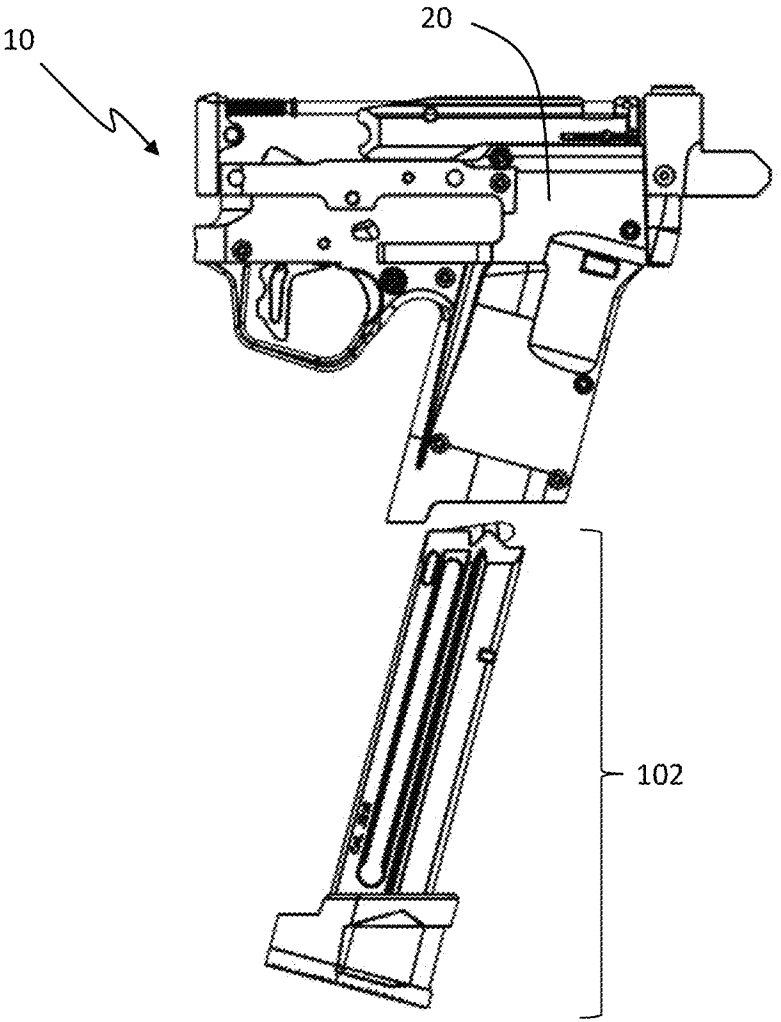
FIG. 2A is a side view illustration of a firearm magazine conversion system with the magazine removed, in accordance with embodiments of the present disclosure.
Figure 1:
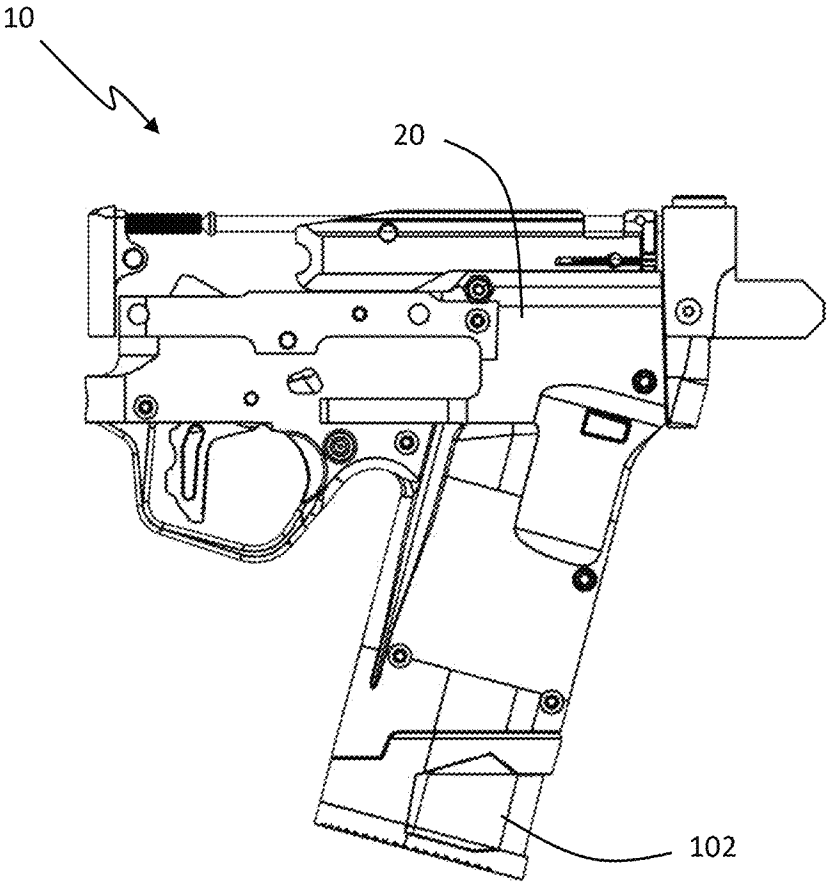
FIG. 1 is a side view illustration of a firearm magazine conversion system with an inserted magazine, in accordance with embodiments of the present disclosure.
Figure 2B:
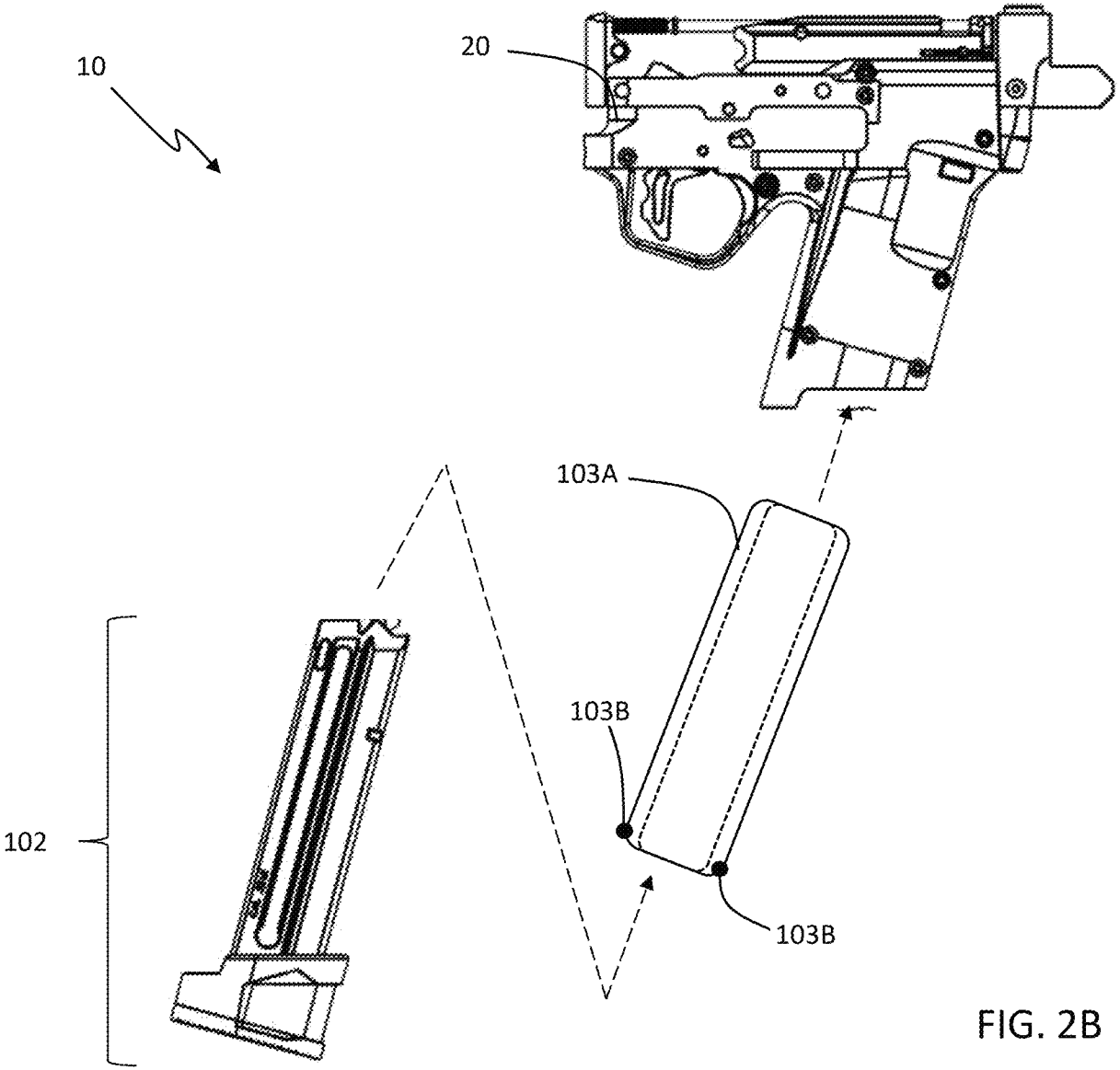
FIG. 2B is a side view illustration of a firearm magazine conversion system with the magazine removed, and with use of a magazine adapter, in accordance with embodiments of the present disclosure.
Figure 3:
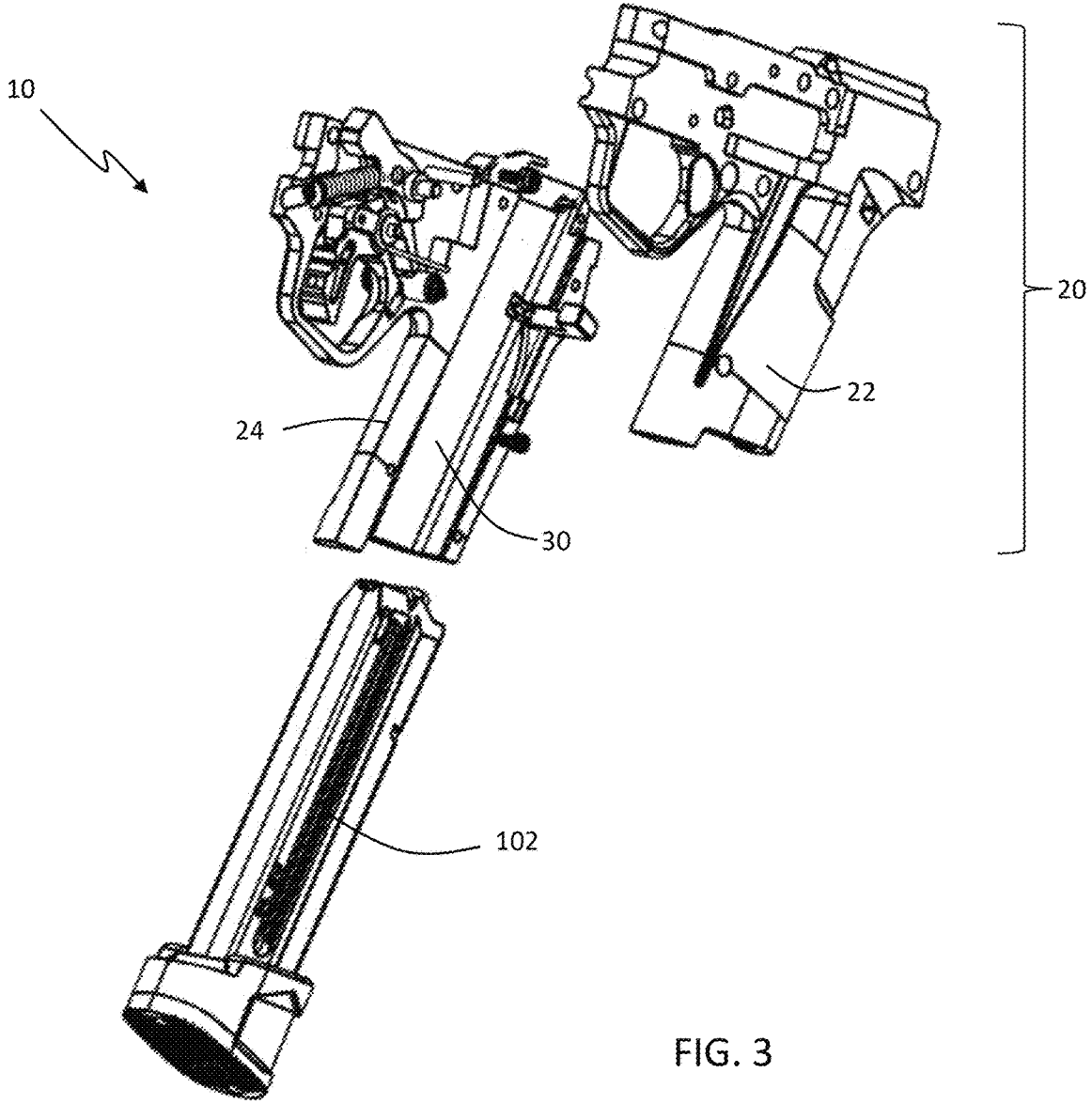
FIG. 3 is an exploded-view illustration of a firearm magazine conversion system with magazine, in accordance with embodiments of the present disclosure.
Figure 4:
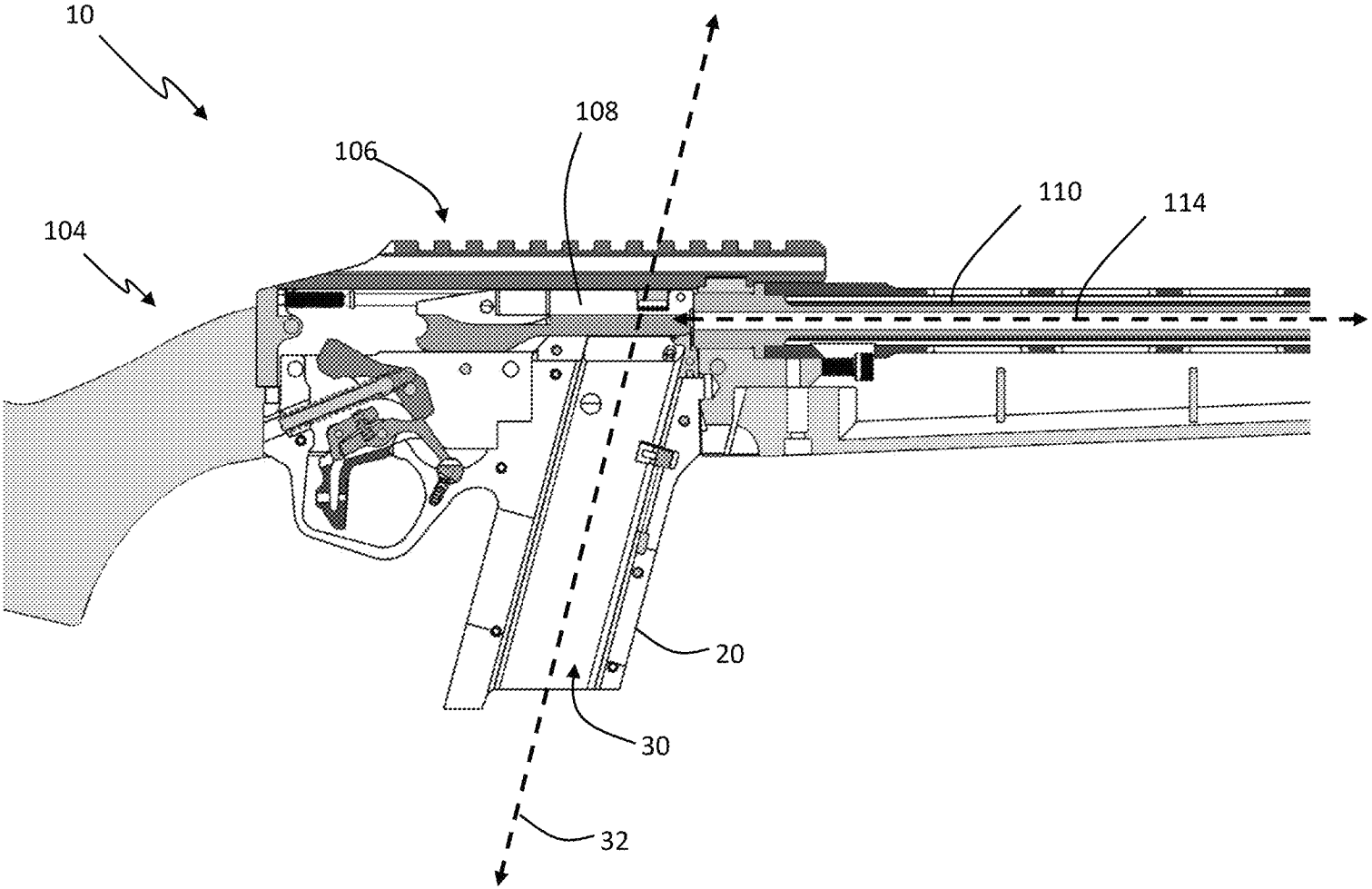
FIG. 4 is a side view, cross-sectional illustration of a firearm having the firearm magazine conversion system, in accordance with embodiments of the present disclosure.
Figure 5:
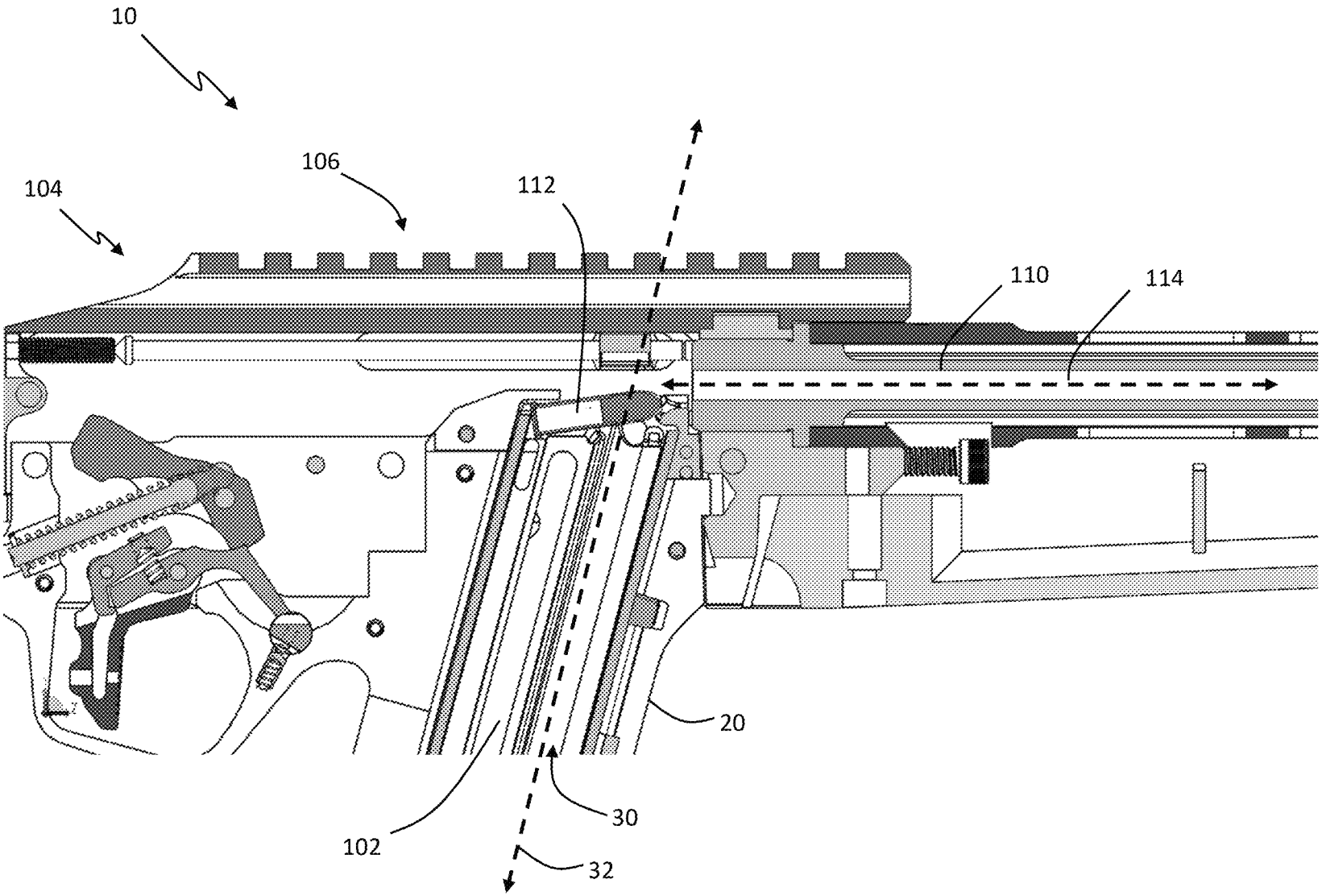
FIG. 5 is a detailed side view, cross-sectional illustration of a firearm having the firearm magazine conversion system with a magazine, in accordance with embodiments of the present disclosure.

FIG. 1 is a side view illustration of the firearm magazine conversion system 10 (hereinafter, 'system 10') with an inserted magazine 102, in accordance with embodiments of the present disclosure. FIG. 2A depicts a side view illustration of the system 10 with the magazine 102 removed, while FIG. 2B illustrates the same side view illustration of the system 10 with a magazine 102 which is used with a magazine adapter 103A. FIG. 3 depicts an exploded-view illustration of the system 10 with the magazine 102. FIGS. 4-5 depict cross-sectional illustrations of the system 10 in use with a firearm 104. Relative to FIGS. 1-5 together, the system 10 includes a lower receiver housing 20 which is connectable to an upper receiver assembly 106 of a firearm 104. The lower receiver housing 20 may be referred to by various names, including a trigger housing or a trigger subassembly, and it typically includes the trigger components, and at least a portion of the receiver mechanisms of the firearm 104.

The upper receiver assembly 106 has a factory bolt 108, which is the OEM bolt that the firearm 104 originated with from the manufacturer, or the same design and construction as the OEM bolt, such as a replacement OEM bolt. The lower receiver housing 20 includes an internal channel 30 which is positioned through the lower receiver housing 20, such as in a space formed between a first side 22 of the lower receiver housing 20 and a second side 24 of the lower receiver housing 20, as depicted in FIG. 3. The internal channel 30 is sized to receive the magazine 102, which may include numerous types of magazines 102. Commonly, the magazine 102 will have a stacked-cartridge configuration, whereby cartridges 112 or rounds are positioned in a stacked linear orientation within the magazine 102, typically staggered.

FIG. 2A illustrates an example where the magazine 102 is insertable into the lower receiver housing 20 directly, such that the magazine 102 occupies substantially all of the space of the internal channel 30. FIG. 2B illustrates a similar example, where a magazine adapter 103A can be used to interface between the magazine 102 and the internal channel 30, such that the internal channel 30 is effectively formed within an internal space of the magazine adapter 103A. A magazine adapter 103 can be used to ensure that a particular type of magazine 102 is able to connect with the lower receiver housing 20 even if that magazine 102 was not initially designed to be used with the lower receiver housing 20. As such, a magazine adapter 103A can be used to configure the spatial and mechanical interface between the magazine 102 and the lower receiver housing 20. The magazine adapter 103A may be removably mounted to the lower receiver housing 20 with fasteners 103B, which may include any type of fastener, including threaded fasteners, friction-fit fasteners, biased fasteners, or others. It is noted the use of a magazine adapter 103A is optional, depending on design and implementation of the system 10.

The system 10 has a design which allows for the magazine 102 to achieve an orientation which positions the cartridge 112 in a discharge or resting location, depicted in FIG. 5, which is equivalent, or functionally equivalent, to the discharge or resting position provided by the original OEM device. In particular, a center axis 32 of the internal channel 30 which is aligned with a length of the internal channel 30, as depicted in FIG. 5, is positioned non-intersecting with a center axis 114 of a bore 110 of the firearm 104. In other words, the center axis 32 of the internal channel 30 is positioned to the side of, or lateral of, the center axis 114 of the bore 110. Details of this positioning can be seen in FIGS. 9-10. Additionally, the center axis 32 of the internal channel 30 is non-perpendicular to the center axis 114 of the bore 110 of the firearm 104 in at least one plane, but often more than one plane. For instance, the position of the lower receiver housing 20 may be angled towards a rear of the firearm 104, such that an angle between the center axis 32 of the channel 30 and the center axis 114 of the bore 110 is greater than 90°, as shown in FIG. 4. More details on this positioning are provided relative to FIG. 6. As such, the position of the internal channel 30 allows for a positioning of the magazine 102 that is off-center and asymmetrical to the center axis 114 of the bore 110 in at least one plane.

Relative to FIG. 3 specifically, the lower receiver housing 20 may be formed from two sides 22, 24 which are mateable together. The junction between the two sides 22, 24 of the lower receiver housing 20 may be aligned with the center axis 114 of the bore 110, which is typically aligned with a center plane of the firearm 104. As such, the lower receiver housing 20 may be positioned centered relative to the firearm 104 overall. The internal channel 30, however, is positioned in a non-planar location relative to this center plane, e.g., such that the internal channel 30 is off-center from this center plane, and off-angle to the center axis 114 of the bore 110. In this position, the internal channel 30 is not perpendicular to the central axis of the bore in at least one plane, but often more than one plane. For instance, in one example, the internal channel 30 may be positioned non-perpendicular to a second axis which is perpendicular to the center axis 114 of the bore 110, such that the internal channel is off-angle in at least two directions.

Figure 6:
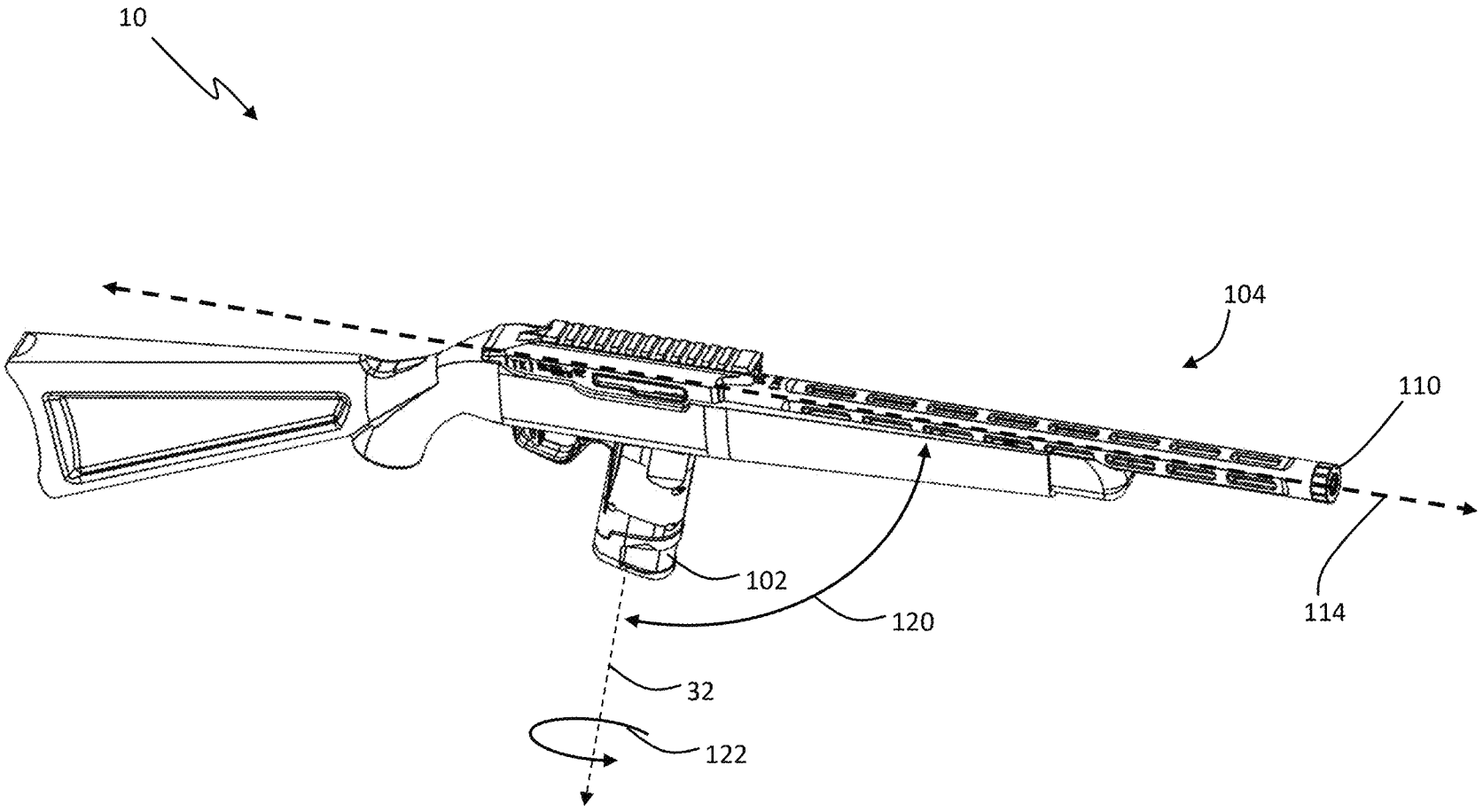
FIG. 6 is an isometric illustration of a firearm having the firearm magazine conversion system with a magazine, in accordance with embodiments of the present disclosure.
Figure 8:
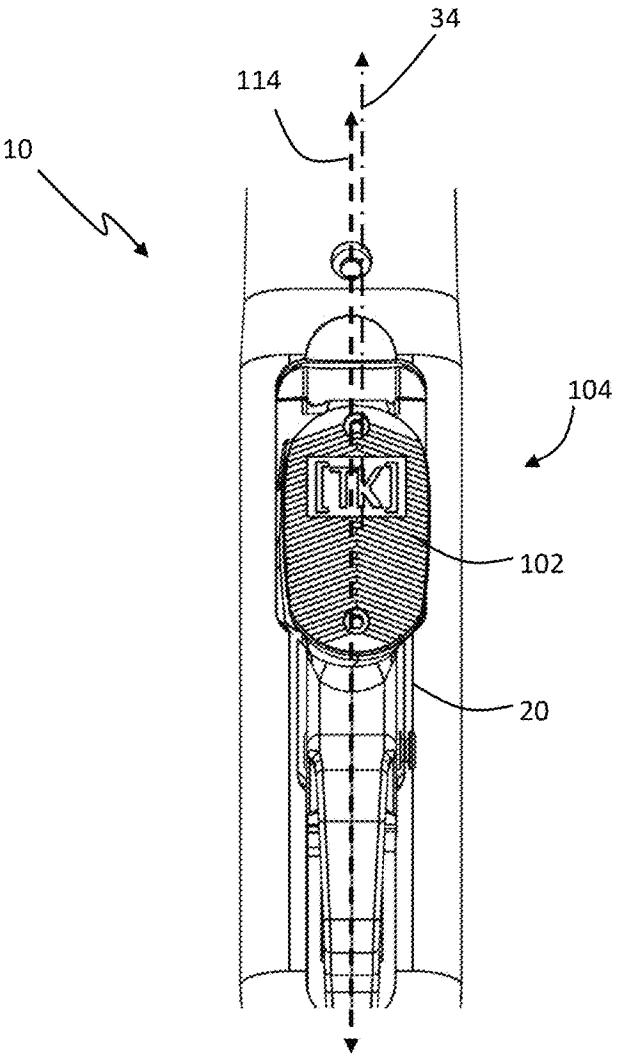
FIG. 8 is a bottom view illustration of a firearm having the firearm magazine conversion system with a magazine, in accordance with embodiments of the present disclosure.
Figure 7:
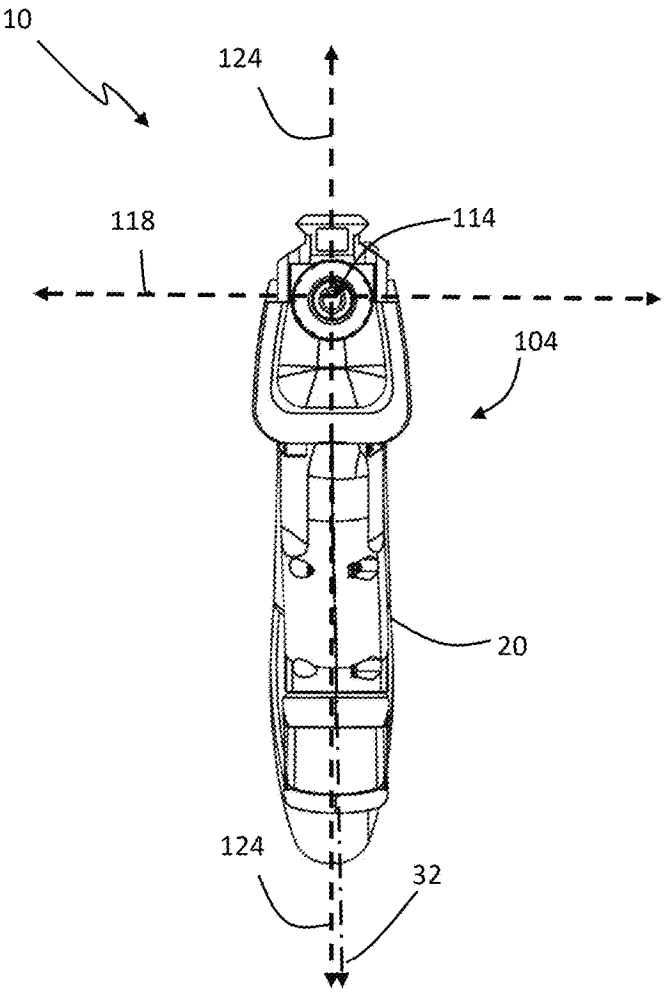
FIG. 7 is a front view illustration of a firearm having the firearm magazine conversion system with a magazine, in accordance with embodiments of the present disclosure.
Figure 10:
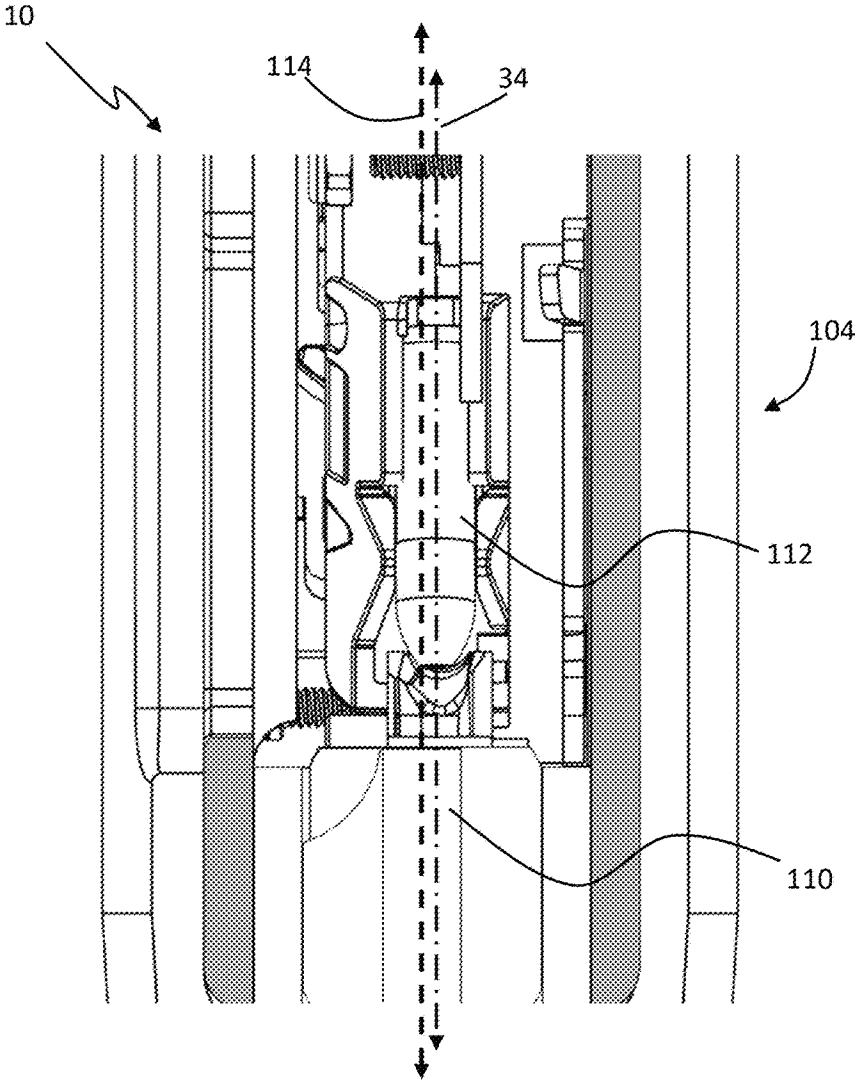
FIG. 10 is a detailed top view illustration of a firearm having the firearm magazine conversion system with a magazine, in accordance with embodiments of the present disclosure.
Figure 9:
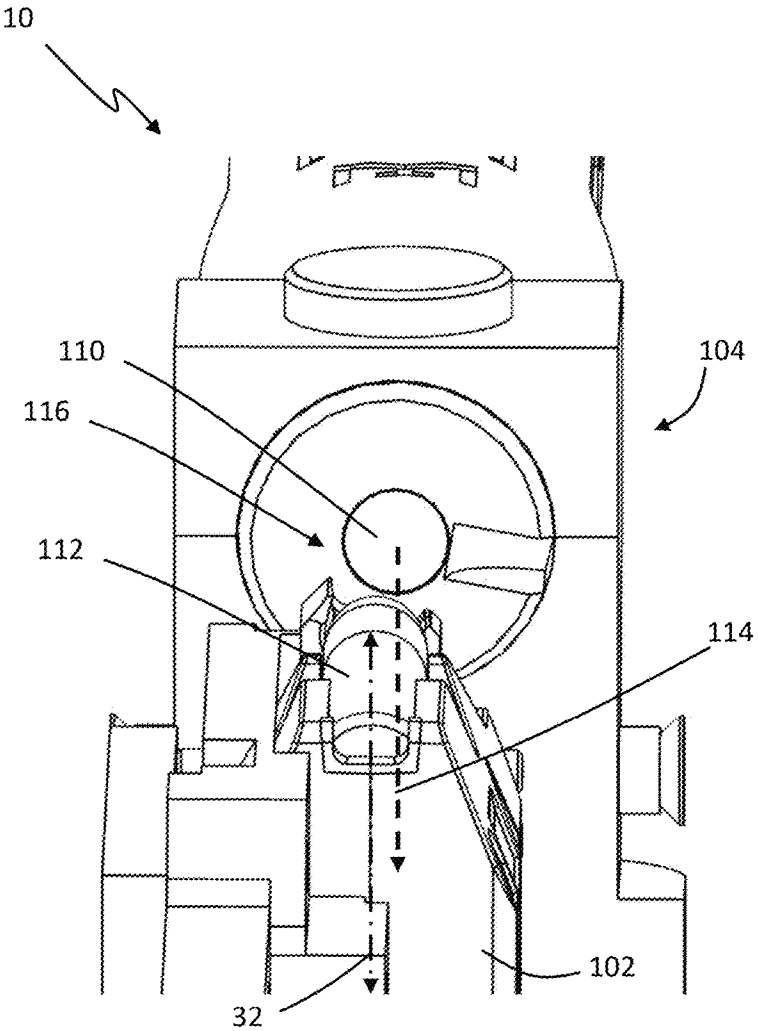
FIG. 9 is a detailed illustration of a firearm having the firearm magazine conversion system with a magazine depicting a breech thereof, in accordance with embodiments of the present disclosure.

FIGS. 6-10 provide further clarity on the relative positioning of the internal channel 30 to the firearm 104. To this end, FIG. 6 is an isometric view, FIG. 7 is a front view, FIG. 8 is a bottom view, FIG. 9 is a detailed rear view depicting a breech 116 of the firearm 104, and FIG. 10 is a top view. As shown in FIG. 6, but with reference to FIGS. 1-10, the center axis 32 of internal channel 30 (shown in FIGS. 3-5) is depicted relative to the center axis 114 of bore 110, where the center axis 32 is positioned asymmetrical to center axis 114 in at least one plane. More specifically, center axis 32 is positioned at a non-perpendicular angle 120 relative to center axis 114 along a length of firearm 104, such that the internal channel 30 within lower receiver housing 20 is not vertical when the center axis 114 of bore 110 is horizontal. In one example, the positioning of the center axis 32 of internal channel 30 may be angled backwards toward the butt of the firearm 104.

The internal channel 30 may also be radially angled relative to the bore 110, and thus, the center axis 114 of the bore 110. For example, as shown in FIG. 6, the internal channel 30 may be formed in the lower receiver housing 20 rotationally non-aligned with center axis 114, such as where internal channel 30 moved a radial angle 122 relative to the firearm 104. This may include, for instance, twisting the internal channel 30 about the center axis 32 such that its front-to-back dimension, e.g., a horizontal axis 34 which extends along a direction between the front and the back of the internal channel 30, as shown in FIG. 8, is not coaxial with center axis 114. This example can be seen in FIG. 8, where the horizontal axis 34 (dot-dash broken lines) of internal channel 30, which extends along a direction between the front and back of the internal channel 30, is not aligned and not coaxial with the center axis 114 (dash-dash broken lines) of the bore 110 (FIG. 8).

Another asymmetrical orientation of the internal channel 30 is depicted in FIG. 7, which shows center axis 32 of internal channel 30 being positioned non-perpendicular to a second axis 118 of firearm 104, which itself is perpendicular to the center axis 114 of the bore 110 and vertical axis 124 of firearm 104. For instance, center axis 32 (dash-dot broken lines) of internal channel 30 may be positioned non-perpendicular to axis 118 (dash-dash broken lines), which is visually apparent in FIG. 7 by the center axis 32 of internal channel 30 being non-aligned with a vertical axis 124 of the firearm 104. Thus, as shown in FIG. 7, a plane oriented along the center axis 32 and the horizontal axis 34 of the internal channel 30 is not coplanar with a plane oriented along the center axis 114 of the bore 110 and the vertical axis 124 of the firearm.

These relative positions orient the internal channel 30 in a skewed position relative to the firearm 104, such that when viewing the firearm 104 from a forward position, the internal channel 30 is positioned asymmetrical to the firearm 104 in at least one direction, but often two directions. Accordingly, when viewing the front view of the firearm 104, the internal channel 30 holding the magazine 102 would extend off-center to the left or right, despite the lower receiver housing 20 being centered. Thus, the internal channel 30 is tilted within the lower receiver housing 20.

FIGS. 9-10 illustrate the center axis 32 of the internal channel 30 in a non-intersecting position with the center axis 114 of the bore 110. In FIG. 9, it can be seen how the internal channel 30 has a position which is offset from center relative to the center axis 114 of bore 110. Here, at the breech 116 of the firearm 104, the center axis 32 of internal channel 30, which is aligned with a length of the internal channel 30, is positioned to the left of the center axis 114 of bore 110. This correlates to the cartridge 112 being positioned offset from center of the bore 110. In FIG. 10, this offset position can be seen clearly, where the horizontal center axis 34 of internal channel 30 is positioned offset from center axis 114 of bore 110.

The system 10 uses the position of the internal channel 30 within the lower receiver housing 20 to provide a canted magazine 102 configuration which uses at least one off-axis configuration, but possibly multiple off-axis configurations. This unique orientation of the magazine 102 allows for a linear-stacked magazine 102 to be used with a factory bolt and provide cartridge placement in the proper position to match the factory bolt.

Relative to FIGS. 6-10, it is noted that system 10 may include any combination of these orientations. For instance, any combination of a non-intersecting position of center axis 32 with center axis 114, or non-perpendicular orientations of center axis 32 or horizontal center axis 34 to the bore 110, or a plane perpendicular to bore 110 may be used. This may provide for an internal channel which is offset, asymmetrical, or non-perpendicular positioned relative to center axis 114 of bore 110 in multiple planes.

Figure 11:
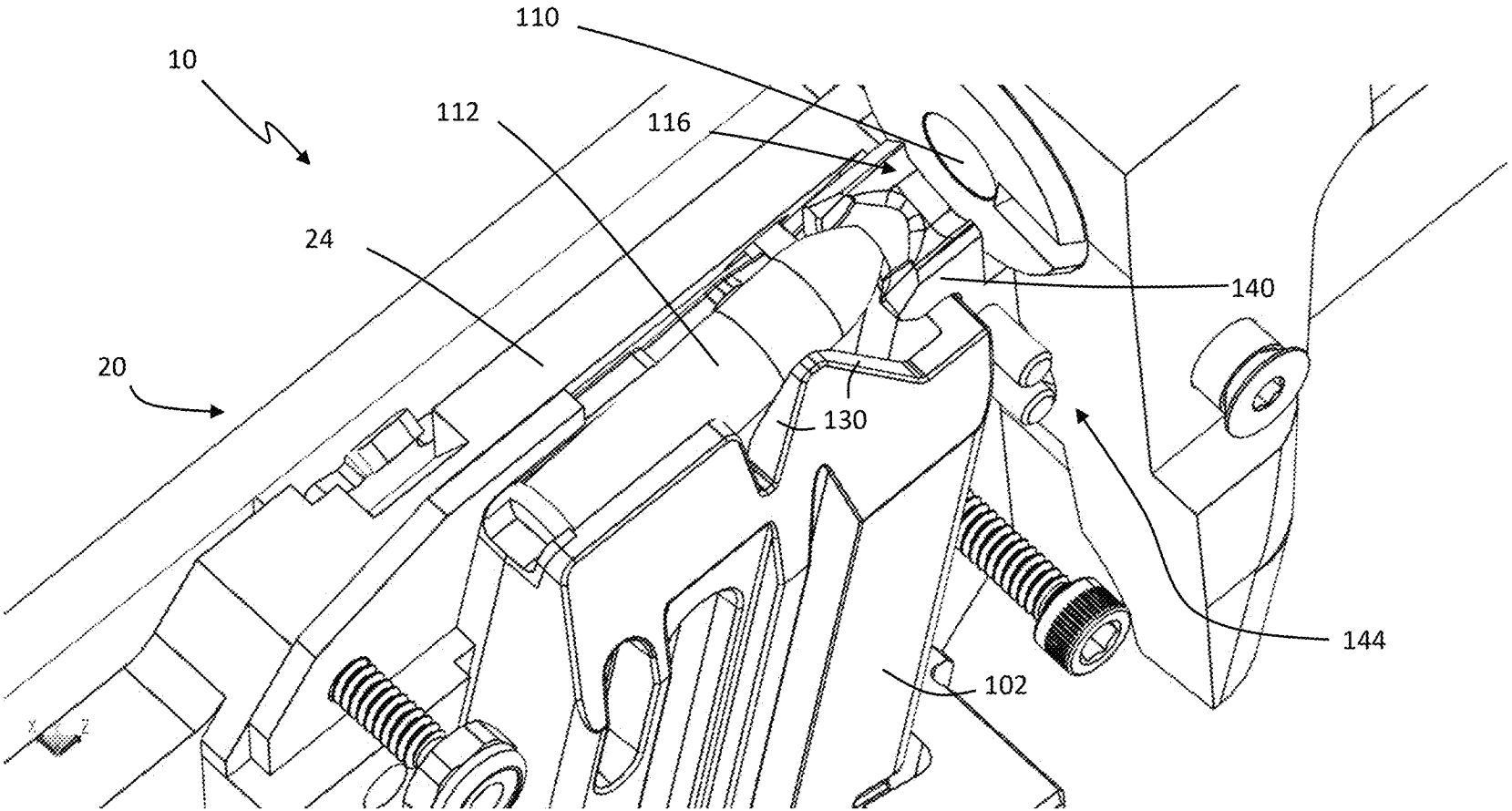
FIG. 11 is an elevated perspective view illustration of a firearm having the firearm magazine conversion system with a magazine depicting a breech thereof, in accordance with embodiments of the present disclosure.
Figure 12:
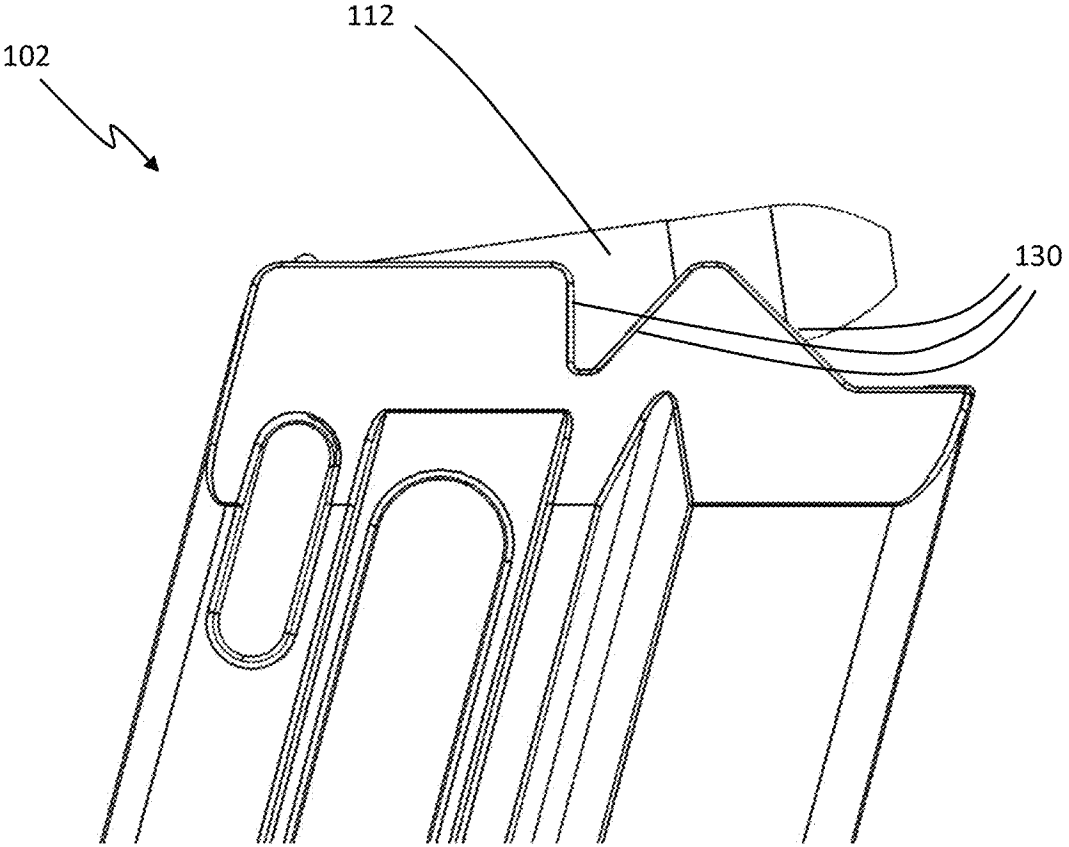
FIG. 12 is a detailed side view illustration of a magazine used with the firearm magazine conversion system, in accordance with embodiments of the present disclosure.
Figure 13:
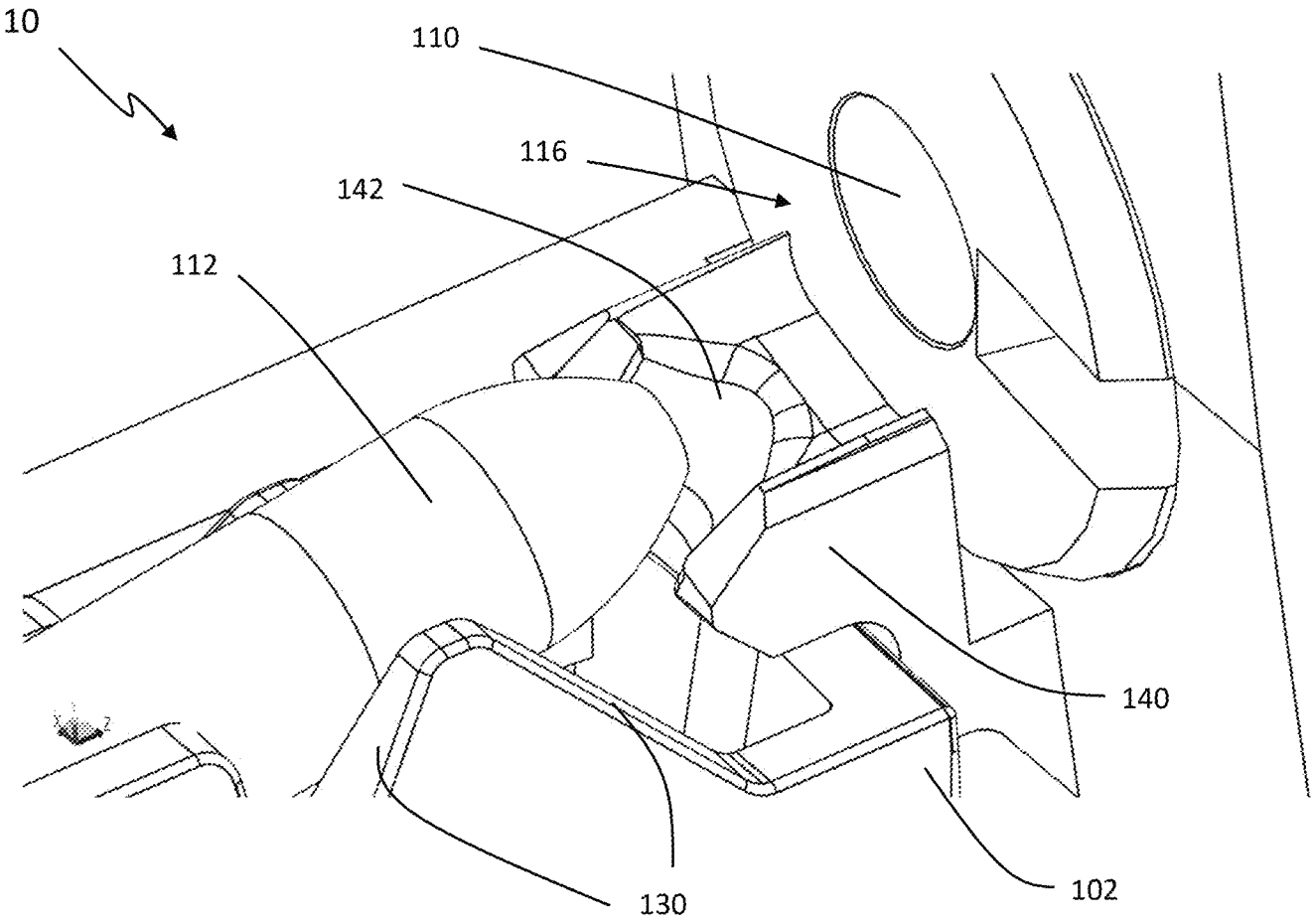
FIG. 13 is a detailed, elevated perspective view illustration of a firearm having the firearm magazine conversion system with a magazine depicting a breech thereof, in accordance with embodiments of the present disclosure.

FIG. 11-13 provide illustrations of features of system 10 which allow cartridge 112 to move from the discharge or resting location of magazine 102 to being loaded into the breech 116 of firearm 104. As shown, the magazine 102 may include a feed lip 130 formed on or near the top surface of magazine 102. The feed lip 130 on the top of the magazine 102 may change based on the design of the magazine 102 and/or based on the caliber of the ammunition. The system 10 may be designed to be used with various magazines 102 having differently configured feed lips 130, including magazines 102 which are provided separately from the system 10. For rim-fire cartridges 112, as depicted, such as .22 long rifle, the feed lip 130 on the magazine 102 is used to load the rim-cartridge 112 into the breech 116.

Movement of the cartridge 112 into the breech 116 occurs with a dynamic motion which is controlled, at least in part, based on the shape of the feed lip 130 of the magazine 102. As the cartridge 112 is being advanced forward towards the breech 116, the rim of the cartridge 112 contacts the feed lip 130, which angularly repositions the cartridge 112 while it is moved forward. For instance, in a starting position with the cartridge 112 in the magazine 102, the nose of the cartridge 112 is typically raised relative to the rim. As the cartridge 112 is advanced forward, the rim of the cartridge 112 contacts the feed lip 130 which causes the rim to raise, thus changing the angle of the cartridge 112, e.g., fully or partially leveling the cartridge 112.

Rotary magazines which are factory made have a design which allows loading of the cartridge 112 without complications from the rim of the cartridge, but linear-stacked magazines 102, as used with the system 10, often have complications due to the rim. Thus, it can be challenging to have a linear-stacked magazine 102 to load cartridges 112 into the breech 116 of the firearm 104 in a manner that matches the cartridge 112 discharge or resting positioning provided by a factory/OEM rotary magazine. The design of the feed lip 130 may assist with proper positioning of the cartridge 112 to alleviate this problem.

The dynamic motion of the cartridge 112 feeding into the breech 116 is also controlled with the feed ramp 140, which is positioned below the breech 116 in a location proximate to a terminating upper end of the internal channel 30. The feed ramp 140 is positioned within the lower receiver housing 20 and may be removably mounted to the lower receiver housing 20 with one or more fasteners 144. The fasteners 144 may include any type of fastener, such as threaded fasteners, friction-fit fasteners, biased fasteners, or others.

The feed ramp 140 has a feeding surface 142 which is configured to mimic the feed path geometry of the OEM device, and/or is designed to have a different geometry to achieve particular performance. The feeding surface 142 is designed to contact the nose of the cartridge 112 while it is being advanced forward, and guides the nose into the breech 116. As such, the feeding surface 142 forms a plane of symmetry that intersects both the cartridge 112 in the top position of the magazine 102, when loaded, and the entrance to the bore 110 along the center axis 114 of the bore 110. As shown in FIGS. 11 and 13, the feed ramp may include a feeding surface 142 which is at least partially concave along a horizontal direction relative to the bore 110 but convex along a linear direction relative to the bore 110. This design may allow the cartridge 112, by contact with the nose to the feeding surface 142, to be moved from the laterally offset position relative to the bore 110 and into a centered position with the bore 110, and moved vertically upwards to the breech 116 from the discharge position in the magazine 102 which is below the breech 116. The concave surface or surfaces It is noted that the shape or contour of the feed lips 130 and/or the feed ramp 140 may be selected to minimize damage or unwanted contact between the nose of the cartridge 112 and the feed ramp 140. Damage to the nose of the cartridge 112 may cause it to deform in shape, which can cause complications with operation of the firearm 104. For example, deformities in the nose can cause failures in the cartridge 112 to chamber properly. In another example, a damaged or deformed nose of the cartridge 112 can significantly affect the accuracy of the firearm 104, since an asymmetrical shape of the nose will negatively influence the flight path of the bullet. Damage or deformities to the nose which are significant enough can also cause more severe complications, such as jamming of the firearm 104 or uncontrolled firings.

Ultimately, the combination of all or part of the magazine 102 placement relative to the bore 110, the contour of the feed lip 130 of magazine 102, and the contour and position of the feed ramp 140 may allow the system 10 to use a stacked-cartridge magazine 102 with a factory bolt for successful operation of the firearm 104. This design of the system 10 allows for the use of an aftermarket magazine 102 with the firearm 104, which are typically not configured to match the exit geometry of the discharge position of a bullet. While many aftermarket magazines 102 are available, they require replacement of the factory bolt to a bolt which is specifically designed for that particular aftermarket magazine 102, which is both costly and tedious. Indeed, replacing the bolt of a firearm 104 may exceed the capabilities of many users, since bolt replacement is beyond a standard field-strip of the firearm 104. The system 10 allows use of an aftermarket magazine 102 while keeping the factory bolt. While the system 10 requires removal of the existing receiver and installation of the lower receiver housing 20, doing so is typically within the comfort level and skill level of most users. Additionally, even with using non-factory magazines 102, the system 10 ensures that the cartridge can be chambered properly and without being damaged, such that performance of the firearm is not decreased.

Other attempts have been made to provide a receiver housing which allows an aftermarket magazine to be used, but these haven't been successful without changing the factory bolt. In one example, a conventional device was proposed to adapt a firearm for use with a KELTEC® CP33 magazine, but it could not be achieved without replacement of the firearm's factory bolt. In contrast, the system 10 may function with a variety of different magazines, as the internal channel of the lower receiver housing 20 may be adapted for various magazine shapes. One exemplary magazine which may be used is the TAURUS® TX22 magazine. The system 10 has proved functional with the TAURUS® TX22 magazine and while using the OEM factory bolt in the firearm.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A firearm magazine conversion system comprising:

a lower receiver housing connectable to an upper receiver assembly of a firearm, the upper receiver assembly having a factory bolt; and an internal channel within the lower receiver housing for receiving a magazine, wherein a center axis of the internal channel aligned with a length of the internal channel is non-intersecting with a center axis of a bore of the firearm, and wherein the center axis of the internal channel is non-perpendicular to the center axis of the bore of the firearm in at least one plane.

2. The firearm magazine conversion system of claim 1, wherein the center axis of the internal channel is positioned lateral to the center axis of the bore.

3. The firearm magazine conversion system of claim 1, further comprising a second axis, the second axis being perpendicular to the center axis of the bore of the firearm, wherein the center axis of the internal channel is non-perpendicular to the second axis of the bore of the firearm.

4. The firearm magazine conversion system of claim 1, wherein the internal channel is radially angled relative to the center axis of the bore.

5. The firearm magazine conversion system of claim 1, further comprising a feed ramp within the lower receiver housing in a position proximate to a terminating upper end of the internal channel, the feed ramp having a feeding surface which forms a plane of symmetry that intersects both a cartridge position in a top position of a magazine within the internal channel and an entrance to the bore along the center axis of the bore.

6. The firearm magazine conversion system of claim 5, wherein the feeding surface is at least partially a concave surface.

7. The firearm magazine conversion system of claim 5, wherein the feed ramp is removably mounted to the lower receiver housing with fasteners.

8. The firearm magazine conversion system of claim 1, further comprising a magazine adapter removably mounted within the lower receiver housing with at least one fastener, wherein the internal channel is formed within the magazine adapter.

9. A firearm magazine conversion system comprising:

a lower receiver housing connectable to an upper receiver assembly of a firearm, the upper receiver assembly having a factory bolt;

an internal channel within the lower receiver housing; and a magazine positioned within the internal channel, wherein a center axis of the internal channel aligned with a length of the internal channel is non-intersecting with a center axis of a bore of the firearm, and wherein the center axis of the internal channel is non-perpendicular to the center axis of the bore of the firearm in at least one plane.

10. The firearm magazine conversion system of claim 9, wherein the center axis of the internal channel is positioned lateral to the center axis of the bore.

11. The firearm magazine conversion system of claim 9, further comprising a second axis, the second axis being perpendicular to the center axis of the bore of the firearm, wherein the center axis of the internal channel is non-perpendicular to the second axis of the bore of the firearm.

12. The firearm magazine conversion system of claim 9, wherein the internal channel is radially angled relative to the center axis of the bore.

13. The firearm magazine conversion system of claim 9, further comprising a feed ramp within the lower receiver housing in a position proximate to a terminating upper end of the internal channel, the feed ramp having a feeding surface which forms a plane of symmetry that intersects both a cartridge position in a top position of the magazine within the internal channel and an entrance to the bore along the center axis of the bore.

14. The firearm magazine conversion system of claim 13, wherein the feeding surface is at least partially a concave surface.

15. The firearm magazine conversion system of claim 13, wherein the feed ramp is removably mounted to the lower receiver housing with fasteners.

16. The firearm magazine conversion system of claim 9, further comprising a magazine adapter removably mounted within the lower receiver housing with at least one fastener, wherein the internal channel is formed within the magazine adapter, and wherein the magazine is positioned at least partially within the magazine adapter.

17. The firearm magazine conversion system of claim 9, wherein the magazine is a stacked-cartridge magazine.

18. The firearm magazine conversion system of claim 17, wherein the magazine has a feed lip, wherein the feed lip causes a rim of a cartridge to raise as the cartridge is moved into a breech of the firearm.

19. A firearm magazine conversion system comprising:

a lower receiver housing connectable to an upper receiver assembly of a firearm, the upper receiver assembly having a factory bolt; and an internal channel within the lower receiver housing for receiving a magazine, wherein a center axis of the internal channel aligned with a length of the internal channel is non-intersecting with a center axis of a bore of the firearm, and wherein the center axis of the internal channel is non-perpendicular to the center axis of the bore of the firearm in at least two planes.

20. The firearm magazine conversion system of claim 19, further comprising a second axis, the second axis being perpendicular to the center axis of the bore of the firearm, wherein the center axis of the internal channel is non-perpendicular to the second axis of the bore of the firearm.

* * * * *